US006002216A

United States Patent [19]

Mateescu

[11] Patent Number: 6,002,216

[45] Date of Patent: Dec. 14, 1999

[54] POOL LIGHTING SYSTEM, ILLUMINATOR, AND METHOD THEREFORE

[75] Inventor: Mihail V. Mateescu, Los Angeles, Calif.

[73] Assignee: Cedars-Sinai Medical Center, Los Angeles, Calif.

[21] Appl. No.: 09/105,325

[22] Filed: Jun. 26, 1998

[51] Int. Cl.[6] ..... H05B 37/00

[52] U.S. Cl. ..... 315/363; 315/158; 362/32; 348/742

[58] Field of Search ..... 315/154–158, 315/363; 348/742, 743; 362/32, 293, 319; 359/385, 889

[56] References Cited

U.S. PATENT DOCUMENTS

| | | | |
|---|---|---|---|
| 2,344,370 | 3/1944 | Shapiro | 240/6.46 |
| 3,555,351 | 1/1971 | Sherwin | 315/155 X |
| 3,609,343 | 9/1971 | Howlett | 240/10 |
| 3,749,901 | 7/1973 | Clough | 240/2 |
| 3,766,376 | 10/1973 | Sadacca et al. | 240/10 L |
| 3,813,514 | 5/1974 | Canty | 219/354 |
| 3,830,395 | 8/1974 | Crisci | 215/321 |
| 4,355,862 | 10/1982 | Kock | 350/96.2 |
| 4,556,280 | 12/1985 | Bagby | 350/96.16 |
| 4,611,600 | 9/1986 | Cohen | 128/667 |
| 4,679,895 | 7/1987 | Huber | 350/96.2 |
| 4,786,127 | 11/1988 | Molnar | 350/96.1 |
| 4,787,698 | 11/1988 | Lyons et al. | 350/96.2 |
| 4,850,669 | 7/1989 | Welker et al. | 350/96.2 |
| 4,887,875 | 12/1989 | Chang et al. | 350/96.21 |
| 5,058,985 | 10/1991 | Davenport et al. | 385/115 |
| 5,165,773 | 11/1992 | Nath | 362/32 |
| 5,184,253 | 2/1993 | Hwang | 359/889 |
| 5,185,837 | 2/1993 | Ayuta et al. | 385/81 |
| 5,268,977 | 12/1993 | Miller | 385/33 |
| 5,303,125 | 4/1994 | Miller | 362/32 |
| 5,315,684 | 5/1994 | Szegda | 385/139 |
| 5,486,984 | 1/1996 | Miller | 362/32 |
| 5,528,714 | 6/1996 | Kingstone et al. | 385/100 |
| 5,548,495 | 8/1996 | Maglica | 362/207 |
| 5,653,519 | 8/1997 | Dobbs | 362/32 |
| 5,706,061 | 1/1998 | Marshall et al. | 348/743 |
| 5,838,860 | 11/1998 | Kingstone et al. | 385/100 |

OTHER PUBLICATIONS

U.S. Patent Application for Illuminator For Fiber Optic Lighting System, Application No. 08/731,797, filed Oct. 18, 1996.

Brochure entitled Fiberworks, User's Manual, by American Products, dated Mar. 12, 1996.

*Primary Examiner*—Haissa Philogene

*Attorney, Agent, or Firm*—Pretty, Schroeder & Poplawski, P.C.

[57] ABSTRACT

In a pool lighting system, each illuminator (10) comprises a color wheel 26, a driver mechanism (24) for rotating the color wheel, and a synchronization circuit (42). The synchronization circuit is responsive to an alternating-current source of power applied to the illuminator to control the driver mechanism to place the color wheel at a predetermined position after a predetermined time subsequent to the alternating-current source of power being initially applied to the illuminator.

15 Claims, 5 Drawing Sheets

FIG. 1
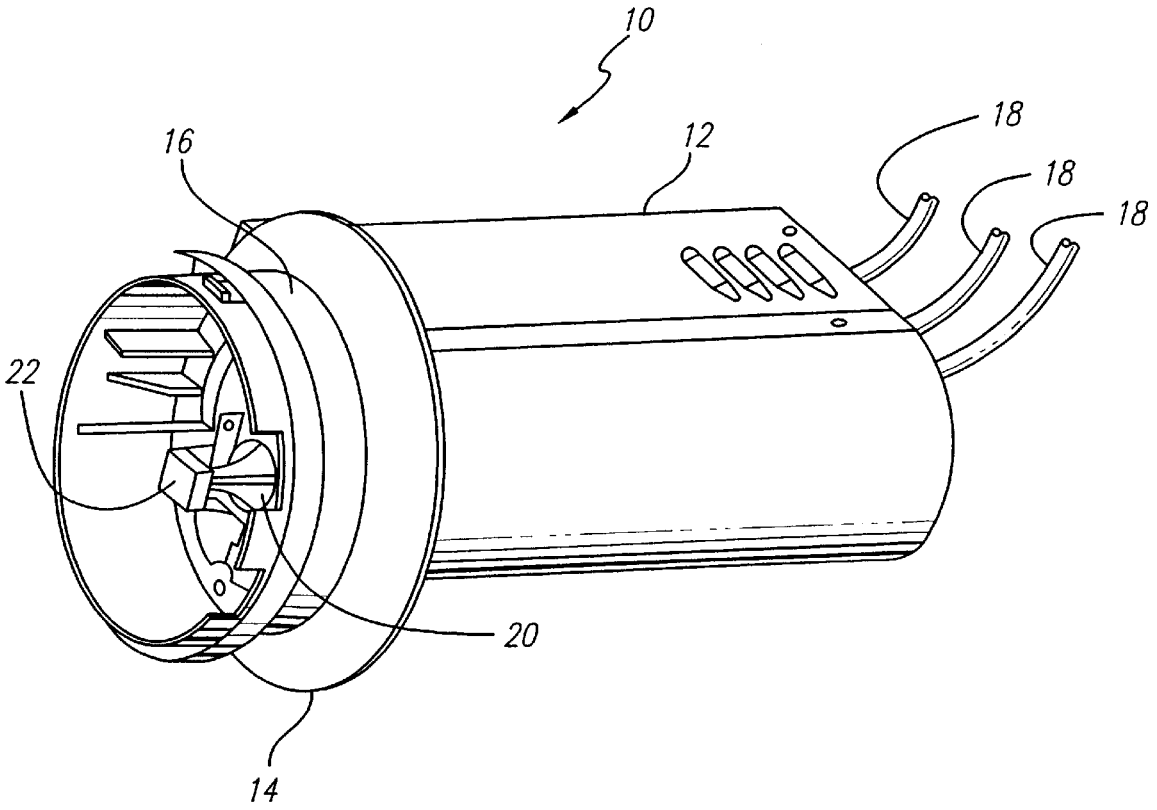
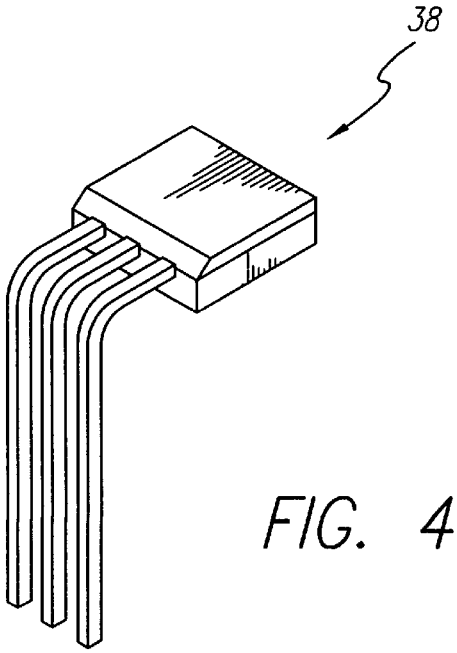
FIG. 4

FIG. 3
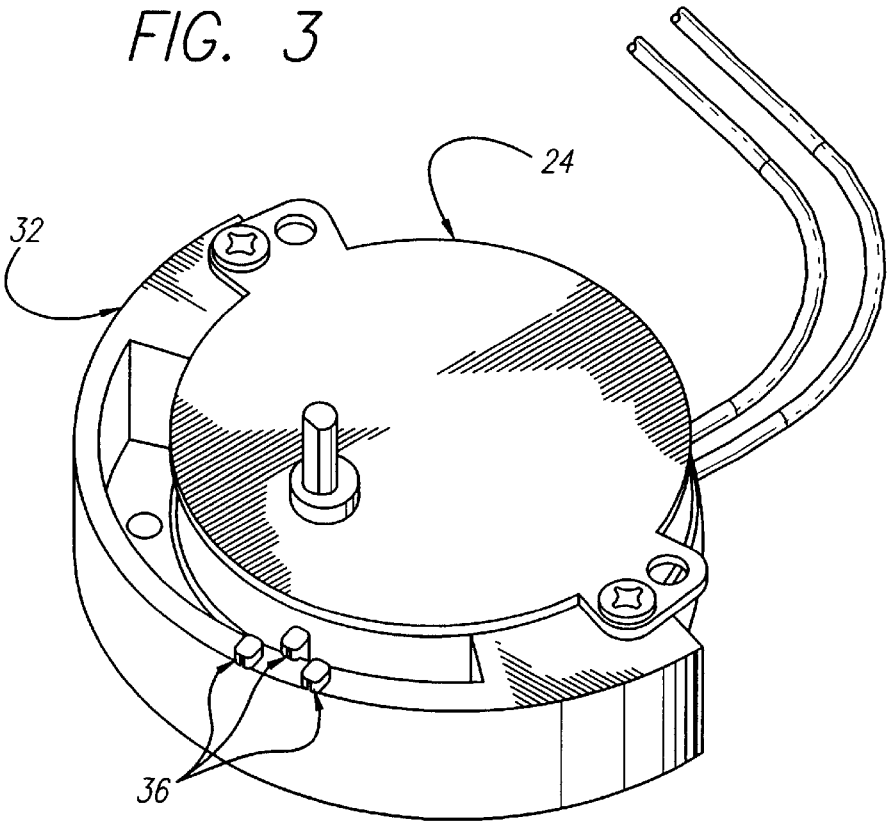
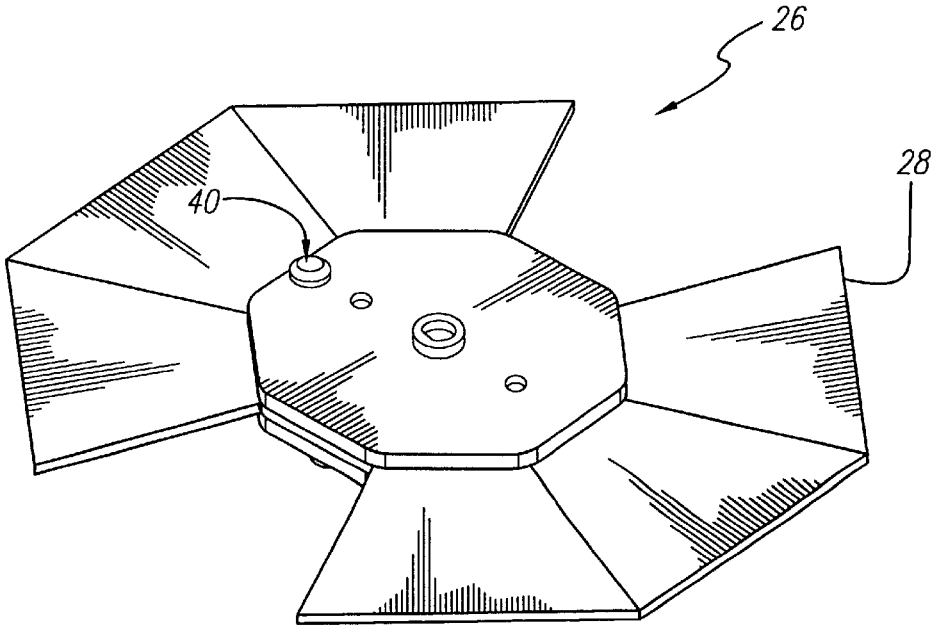
FIG. 5

POOL LIGHTING SYSTEM, ILLUMINATOR, AND METHOD THEREFORE

FIELD OF THE INVENTION

The present invention relates generally to the field of illumination, and, more particularly, to a pool lighting system, illuminator, and method therefore. Although the present invention is subject to a wide range of applications, it is especially suited for use in a pool lighting system, and will be particularly described in that connection.

BACKGROUND OF THE INVENTION

Pool lights illuminate the water at night for the safety of swimmers and for aesthetic purposes. The illumination emanates from underwater lights affixed to the wall of the pool. As used herein, a pool is used generically to refer to a container for holding water or other liquids. Examples of such containers are recreational swimming pools, spas, and aquariums.

To enhance the aesthetics, current underwater pool lights use a transparent color filter or shade affixed to the front of the lens of the pool light to filter the light emanating from the lens of the pool light and thus add color to the pool. The color filters come in a variety of colors but only one of these color filters can be affixed to the pool light at a given time. Thus, the color of the pool stays at that particular color that the color filter passes. In order to change the color of the pool, the color filter must be removed from the pool light and a different color filter installed across the lens of the pool light.

An alternate form of adding color to the pool is through the use of fiber optics. A remote source of color light, referred to as an illuminator, illuminates an end of the fiber-optic cable, and the fiber-optic cable conducts the color light to a fiber optic lens assembly that is installed in the pool light. The source of color light from the illuminator is a bulb and a rotating color wheel that has pie-slice segments that are different color filters. The color wheel, driven by a motor, rotates between the end of the fiber-optic cable and a light bulb. As the different color filters rotate past the bulb, the light passing through the color wheel changes color.

Although an improvement over the color-filter-across-the-lens method of providing color, the fiber-optic cable dissipates the light, and, consequently, multiple illuminators are necessary to provide an acceptable intensity of light at the pool. When more than one illuminator is used, the color wheels of the illuminators must be synchronized to provide the same accent color throughout the water.

To achieve synchronization, known fiber-optic pool lighting systems designate one illuminator as a master unit and the other light sources are referred to as slave units. The master unit generates a master reference signal to which the slave units synchronize their color wheels.

To transmit the master reference signal to each slave unit, a three-wire cable is connected from the master unit to the slave units. Because electrical conduit and wires must installed between the master unit and the slave units, costs are incurred.

A need therefore exists for a synchronization circuit for a pool lighting system, illuminator, and method therefore that can synchronize the color wheels of the illuminators without the additional cost of installing electrical conduit and wires between the master unit and the slave units.

SUMMARY OF THE INVENTION

The present invention, which tends to address this need, resides in a pool lighting system. The pool lighting system described herein provide advantages over known pool lighting system in that it less difficult and costly to install than conventional pool lighting systems that can provide a variety of synchronized colors to the pool water.

According to the present invention, each illuminator of the pool lighting system places the color wheel at a predetermined position after a predetermined time subsequent to an alternating-current (AC) source of power being initially applied to the illuminator. This is accomplished by a driver mechanism for rotating the color wheel, and a synchronization circuit in each illuminator that controls the driver mechanism in response to the AC source of power being applied to the illuminator. Because, each illuminator has its own synchronization circuit, their is no need for wiring from a master unit to slave unit in order to transmit the master reference signal to each slave unit.

In accordance with one aspect of the present invention, the illuminator further includes a sensor that provides a reference position pulse indicating the color wheel is at the predetermined position. The synchronization circuit includes a master clock generator that provides a master reference pulse at the predetermined time and a control circuit that controls the driver mechanism to stop rotating the color wheel when the master reference pulse and the reference position pulse are out of synchronization.

In a detailed aspect of the present invention, the master clock generator counts the sinusoids of the AC source of power to a predetermined modulo corresponding to the predetermined time, when the AC source of power is applied to the illuminator. The master reference pulse is then generated at the predetermined modulo.

In another detailed aspect of the present invention, a magnet is affixed to the color wheel, and a magnetic field detector is affixed to a non-rotating portion of the illuminator. The magnetic field detector generates the reference position pulse when the magnetic field detector detects the magnetic field.

In still another detailed aspect of the present invention, the control circuit includes a D-type flip-flop, and its Q-output provides a control signal to a switch coupled in series with the driver mechanism.

In accordance with another aspect of the present invention, the driver mechanism includes a motor.

In further accordance with the present invention, the control circuit controls the motor to cause the reference position pulse to be generated in synchronization with the master reference pulse.

In accordance with another aspect of the present invention, the control circuit stops the motor when the reference position pulse is not in synchronization with the master reference pulse and restarts the motor upon generation of a subsequent master reference pulse.

In accordance with another aspect of the present invention, the master clock generator repeatedly counts the frequency sinusoids of the AC source of power to the predetermined modulo when the AC source of power is applied to the illuminator. The master reference pulse is generated at each predetermined modulo. Further, the motor is a synchronous motor that rotates the wheel one full revolution from a one master reference pulse to a subsequent master reference pulse after the reference position pulse is synchronized with the master reference pulse.

In accordance with a method for synchronizing the colors of a pool lighting system including a plurality of illuminators, the method performed by each illuminator comprises periodically generating a master reference pulse upon applying the AC source of power to the illuminator, generating a reference position pulse when the color wheel is at a predetermined position, stopping the motor when the reference position pulse is not in synchronization with the master reference pulse, and restarting the motor upon generation of a subsequent master reference pulse.

Other features and advantages of the present invention will be set forth in part in the description which follows and accompanying drawings, wherein the preferred embodiments of the present invention are described and shown, and in part become apparent to those skilled in the art upon examination of the following detailed description taken in conjunction with the accompanying drawings, or may be learned by practice of the present invention. The advantages of the present invention may be realized and attained by means of the instrumentalities and combinations particularly pointed out in the appended claims.

BRIEF DESCRIPTION OF THE DRAWINGS

FIG. 3 is a perspective view of the motor and an adapter of the illuminator shown in FIG. 1.

FIG. 4 is a perspective view of a sensor of the illuminator shown in FIG. 1.

FIG. 5 is a perspective view of a color wheel and a magnet mounted thereon of the illuminator shown in FIG. 1.

DESCRIPTION OF THE PREFERRED EMBODIMENTS

Figures 1, 6:
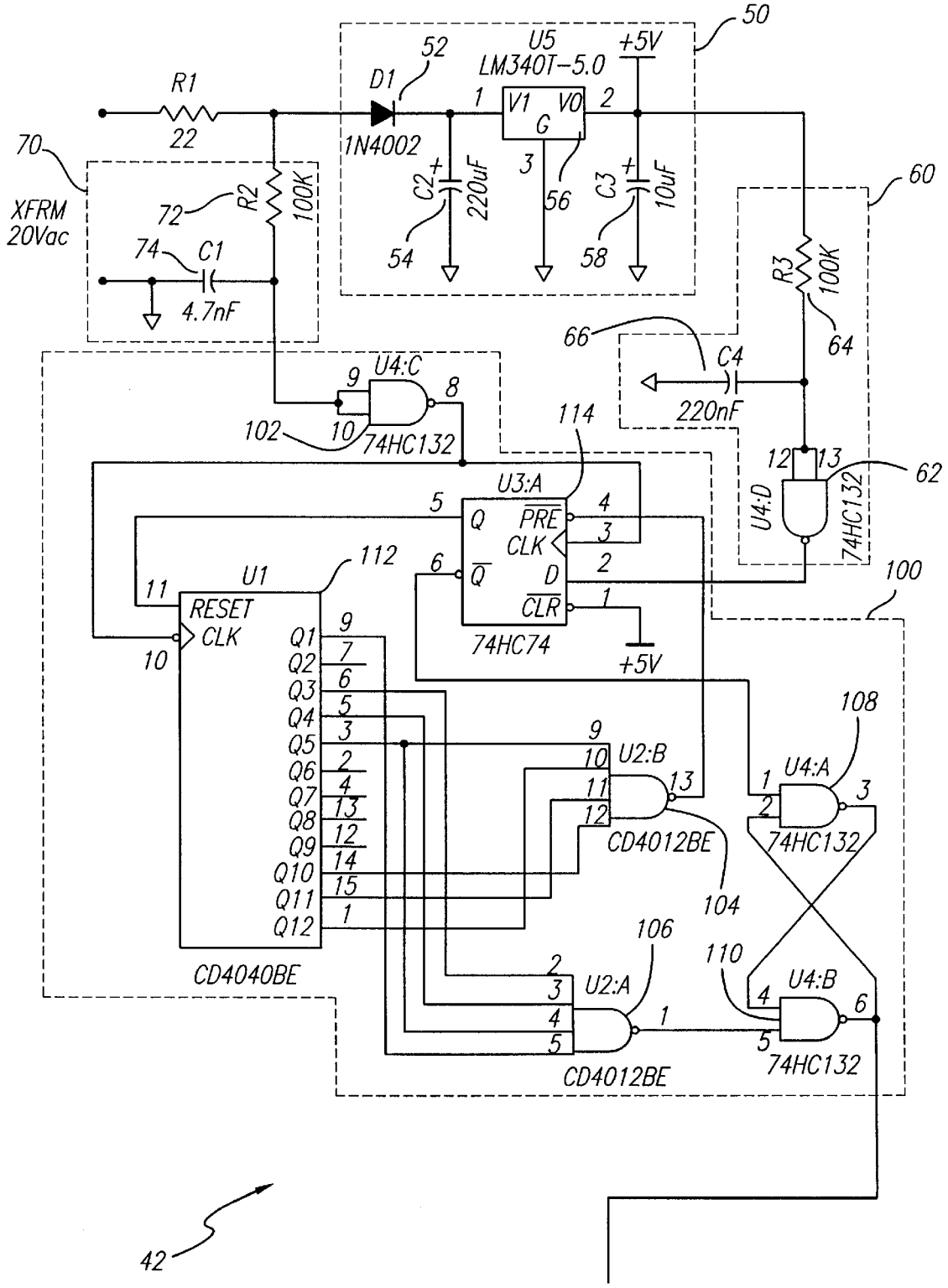
FIG. 1 is a perspective view of an illuminator without its lid and a plurality of bundles of fiber-optic cables.
FIG. 6 is an electrical schematic of a synchronizer circuit of the illuminator shown in FIG. 1.
Figures 2, 6:
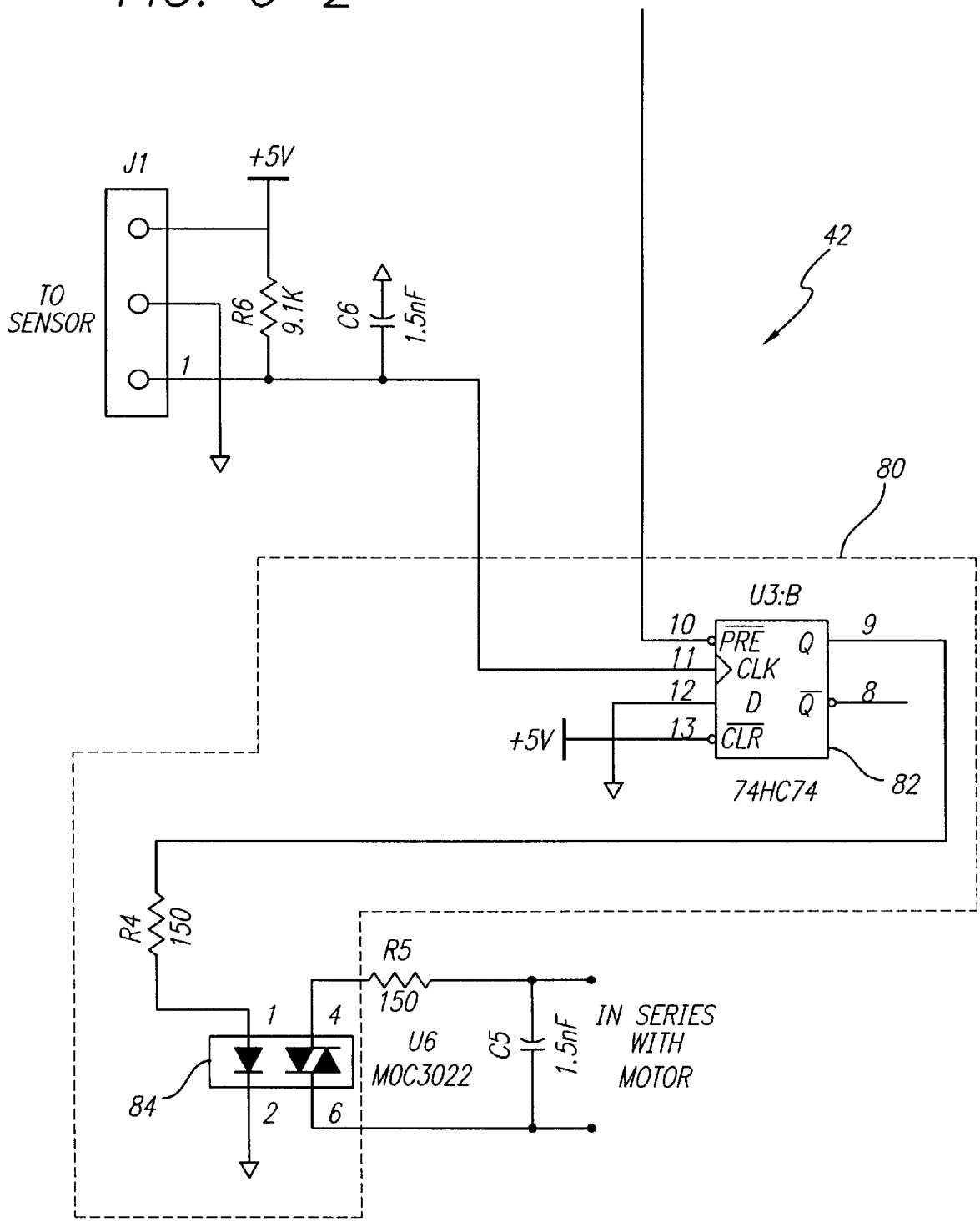

As shown in the exemplary drawings, and with particular reference to FIG. 1, which is a perspective view of an illuminator without its lid and a plurality of bundles of fiber-optic cables extending therefrom, the present invention is embodied in an illuminator 10 comprising a base 12, a support bracket 14 mounted on base 12, and a tubular window 16 mounted on support bracket 14. A plurality of bundles of fiber-optic cables 18 extend from base 12 to provide light to a pool. Illuminator 10 further comprises at least one bulb 20 mounted in a socket 22 of the support bracket 14.

Figure 2:
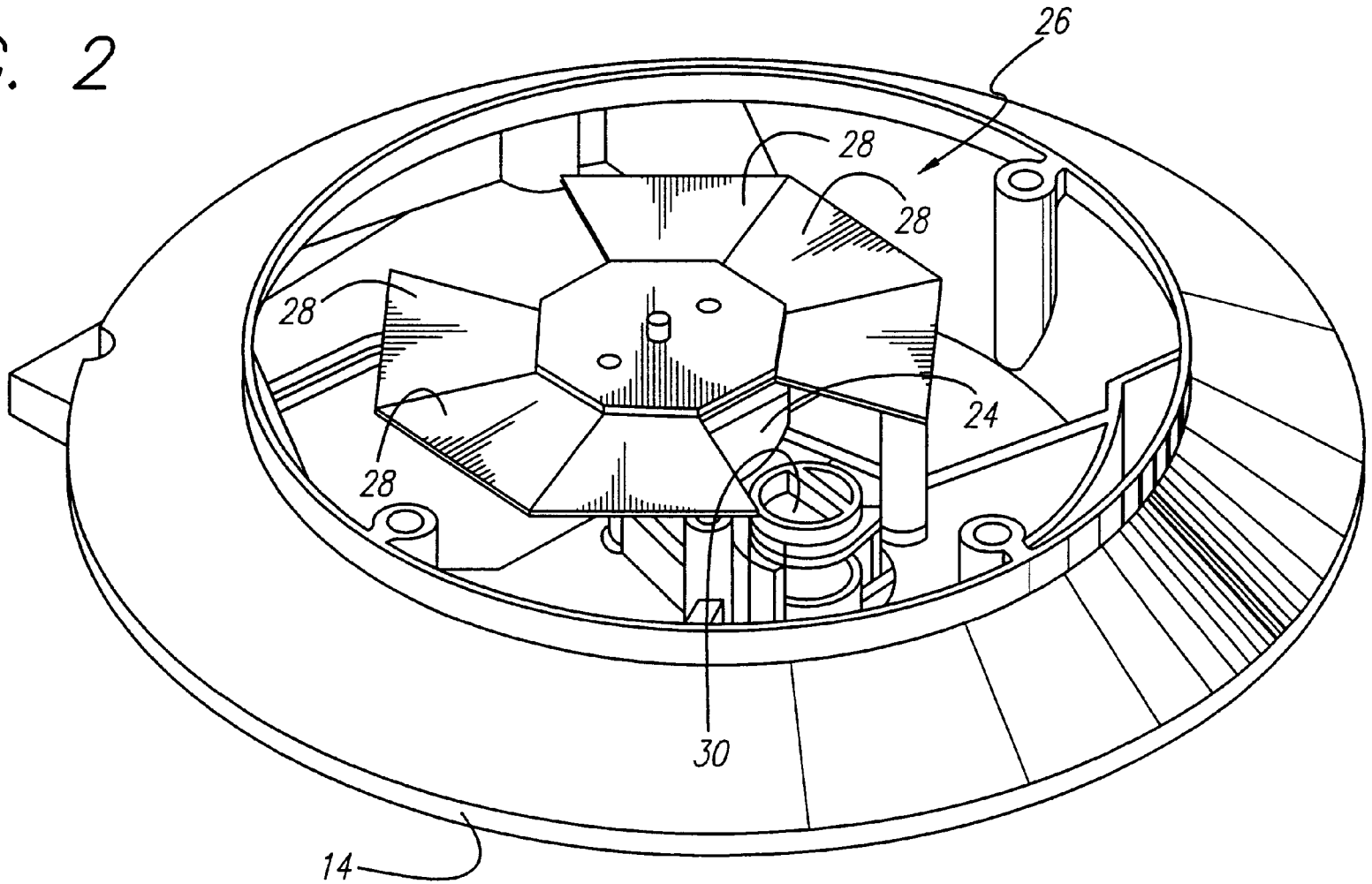
FIG. 2 is a perspective view of a support bracket, a color wheel, and a motor, of the illuminator shown in FIG. 1.

Referring to FIG. 2, which is a perspective view of support bracket 14, a driver mechanism 24, such as, a motor, is mounted on support bracket 14, and a color wheel 26, is mounted on motor 24. The bundles of fiber-optic cables 18 can have their one ends disposed in a portal 30 formed on support bracket 14. In this configuration, color wheel 26 is disposed between the at least one bulb and the at least one bundle of fiber-optic cables.

Driver mechanism 24 rotates color wheel 26, and color wheel 26 has a plurality of color filters 28 that pass sequentially between the at least one bulb and the at least one bundle of fiber-optic cables. The color filters filter the light emanating from bulb 18. The filtered light is transmitted to the pool via the bundles of fiber-optic cables 18.

Referring to FIG. 3, which is a perspective view of motor 24 and an adapter 32, color wheel 26 is mounted to a shaft 34 of motor 24 that can rotate at a predetermined speed. An example of a motor suitable for this purpose is Model No. M001 available from Mallory of Indianapolis, Ind.

Adapter 32 is mounted to support bracket 14, thus making it a non-rotating portion of illuminator 10, among others. Adapter 32 has sensor guides 36 formed thereon for mounting a sensor 38 (see FIG. 4) to adapter 32.

Referring to FIG. 4, a perspective view of a sensor is shown. The sensor is responsive to the position of the color wheel and provides a reference position pulse indicating the color wheel is at the predetermined position. The sensor can be a magnetic field detector affixed to a non-rotating portion of the illuminator, and the magnetic field detector generates the reference position pulse when the magnetic field detector detects the magnetic field. An example of a sensor suitable for use in the invention is Model No. A3144EU available from Allegro of Worcester, Mass.

Referring to FIG. 5, which is a perspective view of color wheel 26 and a magnet 40, magnet 40 is affixed to the underside of color wheel 26 in relationship to sensor 38 such that as magnet 40 rotates with color wheel 26, sensor 38 senses the magnetic field generated by magnet 40.

The technique for making an illuminator as described in the aforementioned paragraphs is well-known in the art and readily understood by one of ordinary skill in the art based on the foregoing description. An example of a typical construction of an illuminator is Model No. 20100600, available from PacFab, Inc., 10951 West Los Angeles Ave., Moorpark, Calif. 93021.

According to the present invention, a synchronization circuit, which generates a master reference signal, is included in every illuminator of the pool lighting system. Thus, a master reference signal is generated in every illuminator. Accordingly, there are no slave units and no need for wiring from a master unit to slave unit in order to transmit the master reference signal to each slave unit.

The master reference signals are synchronized together by making the synchronization circuit responsive to a common AC source of power that is applied to each illuminator. When all of the master reference signals are synchronized together, then all of the color wheels are synchronized and the same accent color from the illuminators is provided to the pool water.

The synchronization circuit of each illuminator synchronizes the color wheel by controlling the driver mechanism to place the color wheel at a predetermined position after a predetermined time subsequent to the alternating-current source of power being initially applied to the illuminator. This assures that the color wheels are synchronized.

The synchronization circuit includes a master clock generator that counts the frequency sinusoids of the AC source of power to a predetermined modulo when the AC source of power is applied to the illuminator The master reference pulse is generated at the predetermined modulo.

The master clock generator starts counting from zero when the power to the illuminator is initially applied. If the power to the illuminators is applied at the same instant, then each master clock generator holds the same value at all times. Therefore, the master reference pulses will be in synchronization.

Referring to FIG. 6, which is an electrical schematic of a synchronizer circuit 42 configured according to the present invention, synchronizer circuit 42 includes a voltage regulator 50, a reset circuit 60, a filter 70, a control circuit 80, and a master clock generator 100.

Voltage regulator 50 receives the AC source of power applied to the illuminator and provides a regulated 5 volt (V) output. When the AC source of power is not applied to the illuminator, the output goes to 0 V. In this particular embodiment, voltage regulator 50 comprises a half-wave rectifier including a diode 52 and capacitor 54. The rectified signal is provided to a limiter 56 that clips the voltage to 5 V. A capacitor 58 filters unwanted frequency components of the regulated 5 volt (V) output.

Reset circuit 60 provides a reset signal on its output that assists in resetting a counter (described below) when the AC source of power is initially applied to the illuminator. Reset circuit 60 comprises a NAND-gate 62 and resistance-capacitance network including a resistor 64 and a capacitor 66. When the AC source of power is not applied, the inputs to NAND-gate 62 are 0 V (referred to as digital "zero" or "0") and the output is 5 V (referred to as digital "one" or "1"). When the AC source of power is initially applied, capacitor 66 charges slowly to 5 V, and the output of NAND-gate 62 changes from "1" to "0."

Filter 70 prevents unwanted high-frequency components of the AC source of power applied to it from passing to master clock generator 100. Filter 70 comprises a resistor 72 and a capacitor 74 in a low-pass filter configuration.

Coupled to reset circuit 60 and filter 70 is master clock generator 100. Master clock generator 100 receives the reset signal provided by reset circuit 60 and the AC source of power filtered by filter 70. In response to these inputs, master clock generator provides the master reference pulse at the predetermined time on its output.

Master clock generator 100 comprises NAND-gates 102, 104, 106, 108, and 110, a counter 112, a D-type flip-flop 114.

NAND-gate 102 is a Schmitt trigger that converts the sinusoidal AC source of power provided to its input into a square wave at its output that is a "1" during the negative sinusoid and a "0" during the positive sinusoid. In other words, a pulse is generated for each sinusoid of the AC source of power. The pulses on the output of NAND-gate 102 are provided to the clock inputs of counter 112 and D-type flip-flop 114 and are their clock signal.

Counter 112 successively counts from 0 to 3599 (total count of 3600) when a "0" is applied to its RESET-input and the clock signal is applied to its CLOCK-input. When a "1" is applied to its RESET-input, the counter will reset to 0. As will be described, a "1" is applied to the RESET-input upon reaching the count of 3600 to reset the counter to 0.

NAND-gate 62, D-type flip-flop 114, and NAND-gate 104 are used to reset counter 112 to 0.

The output terminals Q5, Q10, Q11, and Q12 of counter 112 assist in generating a preset signal. Upon counting to 16 (0 to 15), a "1" is applied to Q5; upon counting and additional 512, a "1" is applied to Q10; upon counting an additional 1024, a "1" is applied to Q11; and upon counting an additional 2048, a "1" is applied to Q12. The sum of this count is 3600.

The outputs on output terminals Q5, Q10, Q11, and Q12 are applied to NAND-gate 104. The output of NAND-gate 104 is provided to the inverse PRESET-input of D-type flip-flop 114. NAND-gate 104 will provide a "1" on its output as long as one of the inputs is a "0," that is, during the count from 0 to 3599 . The output will change to "0" when the count reaches 3600 and all of the outputs on output terminals Q5, Q10, Q11, and Q12 are a "1."

The operation of counter 112 will now be described.

When the AC source of power is initially applied to the illuminator, the clock signal begins; the input applied to the D-input is "1" until capacitor 66 charges to "1"; and the input applied to the inverse PRESET-input is "1" because the outputs on output terminals Q5, Q10, Q11, and Q12 of counter 112 are a 0. Under this condition, the "1" on the D-input is applied to the Q-output. The Q-output is coupled with the RESET-input of counter 112, and the "1" on the Q-output casuses counter 112 to reset the count to 0.

Resistor 64 and a capacitor 66 are chosen to have a time constant that allows capacitor 66 to charge to a "1" during the first two sinusoids. Thus, the input applied to the D-input is changing from "1" to "0" after the first two sinusoids. Afterwards, D-input remains at "0" while the AC power is applied to the illuminator and the inverse PRESET-input remains at "1" during the count 0 through 3599 . Under this condition, the "0" on the D-input is applied to the Q-output, which does not cause counter 112 to reset to 0.

Upon reaching a count of 3600, the output of NAND-gate 104 goes to "0" and is applied to the inverse PRESET-input of D-type flip-flop 114. Consequently, the D-input is overridden, and a "1" is applied to the Q-output, which in turn causes counter 112 to reset to 0. Now the output of NAND-gate 104 goes back to "1." On the next clock pulse, the output of D-type flip-flop 114 goes to "0," and the cycle repeats itself, with counter 112 continuing to be reset upon reaching successive counts of 3600.

NAND-gates 108 and 110 are used to generate the master reference pulse. NAND-gates 108 and 110 are configured as a bistable circuit, and its output is the master reference pulse. The bistable circuit is an RS-type. In this particular embodiment, the inverse Q-output of D-type flip-flop 114 is provided to the input of NAND-gate 108, and the output of NAND-gate 106 is provided to the input of NAND-gate 110.

Application of the inverse Q-output of D-type flip-flop 114 to NAND-gate 108 causes the output of the bistable circuit to change state upon reaching a count of 3600. Application of the output of NAND-gate 106 to NAND-gate 110 causes the output of the bistable circuit to change state upon reaching a count of 29. Thus, as will be described, the master reference signal will be a "0" for the first 29 counts and a "1" for the remaining counts to 3599.

The outputs on output terminals Q1, Q3, Q4, and Q5 are applied to the inpuits of NAND-gate 106. Upon counting to 1, a "1" is applied to Q1; upon counting an additional 4, a "1" is applied to Q3; upon counting an additional 8, a "1" is applied to Q11; and upon counting an additional 16, a "1" is applied to Q12. The sum of this count is 29 . Consequently, the output of NAND-gate 106 will be a "1" for the first 29 counts and will change to state "0" at count 29.

The operation of the bistable circuit will now be described.

When the AC source of power is intially applied to the illuminator, a "0" on the inverse Q-output of D-type flip-flop 114 and a "1" on the output of NAND-gate 106 is provided to the bistable circuit Under this condition, the output of the bistable circuit is a "0" and remains a "0" until the output of NAND-gate 106 goes to a "0" on the count of 29. This causes the output of the bistable circuit to go to a "1."

The output of the bistable circuit remains a "1" until the next change in state of an input, which will be the inverse Q-output going to a "0" when the count of 3600 is reached. At this point, the output of the bistable circuit changes to "0." This cycle continues with the master reference pulse being a "0" for the 29 counts.

Control circuit 80 controls the driver mechanism to stop rotating the color wheel. Control circuit 80 comprises a D-type flip-flop 82 and a switch 84.

The D-type flip-flop 82 is responsive to the master reference signal and the reference position signal to provide a control signal on its Q-output. D-type flip-flop 82 has its D-input coupled to ground, its inverse PRESET-input receives the master reference signal, and its CLOCK-input receives the reference position signal provided by the sensor.

Switch 84 is coupled in series with driver mechanism 24, and switch 84 opens and closes in response to the control signal. When the switch is open, the driver mechanism stops, which in turn stops the rotation of the color wheel. When the switch is closed, the driver mechanism starts, which in turn rotates the color wheel. In this particular embodiment, the switch is an optical switch.

The operation of D-type flip-flop 82 will now be described.

As sensor 38 detects the magnetic field, it generates the reference position signal, which is a clock signal to D-type flip-flop 82. If the signal applied to the inverse PRESET input is a "1," indicating that the master reference pulse is not being generated, then the D-input of"0" is applied to the Q-output. An output of "0" cannot drive the light-emitting diode of the optical switch, and thus the switch is open. If the signal applied to the inverse PRESET input is a "0," indicating that the master reference pulse is being generated, then a "1" is applied to the Q-output. An output of "1" drives the light-emitting diode of the optical switch, and thus the switch is closed and the color wheel rotates.

One of ordinary skill in the art will appreciate that other types of flip-flops can be used and configured to achieve functional and structural equivalence to the above-describe D-type, for example, an RS-type, JK-type, or T-type.

In effect, when the master reference pulse and the reference position pulse are out of synchronization, the motor is stopped with the color wheel in a position with the magnet adjacent to the sensor. The motor is restarted upon generation of a subsequent master reference pulse. If the motor is a synchronous motor that rotates the wheel one fill revolution from a one master reference pulse to another, then the subsequent reference position pulse will be generated in synchronization with the subsequent master reference pulse. In this particular embodiment, the synchronous motor makes one full rotation in 3600 sinusoids, which is one minute for a 60 Hertz signal. The period between successive master reference pulses is also one minute, which is a count of 3600 sinusoids. Consequently, at the end of one minute after turning on power to the illuminators, all of the color wheels will be in synchronization.

In conclusion, the pool lighting system, illuminator, and method described herein provides less difficult and costly installation than conventional pool lighting systems that can provide a variety of synchronized colors to the pool water. This is primarily accomplished by a providing a synchronization circuit in every illuminator of the pool lighting system. Thus, a master reference signal is generated in every illuminator. Accordingly, there are no slave units and no need for wiring from a master unit to slave unit in order to transmit the master reference signal to each slave unit.

Those skilled in the art will recognize that other modifications and variations can be made in the pool lighting system, illuminator, and method of the present invention and in construction and operation of the pool lighting system and illuminator without departing from the scope or spirit of this invention.

What is claimed is:

1. An illuminator comprising:

a color wheel;

a driver mechanism for rotating the color wheel; and a synchronization circuit, responsive to an alternating-current source of power applied to the illuminator, for controlling the driver mechanism to place the color wheel at a predetermined position after a predetermined time subsequent to the alternating-current source of power being initially applied to the illuminator, wherein the color wheel of each illuminator of a plurality of illuminators powered by the same alternating-current source of power is synchronized to all other color wheels.

2. The illuminator of claim 1 further comprises:

a sensor, responsive to the position of the color wheel, for providing a reference position pulse indicating the color wheel is at the predetermined position;

wherein the synchronization circuit includes, a master clock generator, responsive to the alternating-current source of power applied to the illuminator, for providing a master reference pulse at the predetermined time, and a control circuit, responsive to the master reference pulse and the reference position pulse, for controlling the driver mechanism to stop rotating the color wheel when the master reference pulse and the reference position pulse are out of synchronization.

3. The illuminator of claim 2, wherein the master clock generator counts the sinusoids of the alternating-current source of power to a predetermined modulo corresponding to the predetermined time, when the alternating-current source of power is applied to the illuminator, wherein the master reference pulse is generated at the predetermined modulo.

4. The illuminator of claim 2 further comprises:

a magnet, affixed to the color wheel, for generating a magnetic field;

wherein the position detection circuit includes a magnetic field detector affixed to a non-rotating portion of the illuminator, and the magnetic field detector generates the reference position pulse when the magnetic field detector detects the magnetic field.

5. The illuminator of claim 2, wherein the control circuit includes:

a D-type flip-flop including, a D-input coupled to ground, a PRESET-input for receiving the master reference signal, a CLOCK-input for receiving the reference position signal, and a Q-output, responsive to the master reference signal and the reference position signal, for providing a control signal; and a switch coupled in series with the driver mechanism, wherein the switch opens and closes in response to the control signal.

6. The illuminator of claim 1, wherein the color wheel includes a plurality of color filters.

7. The illuminator of claim 1, wherein the driver mechanism includes a motor.

8. An illuminator comprising:

a color wheel;

a magnet, affixed to the color wheel, for generating a magnetic field;

a motor for rotating the color wheel;

a sensor, affixed to a non-rotating portion of the illuminator, for generating a reference position pulse each time the sensor senses the magnetic field as the magnet rotates with the color wheel;

a master clock generator, responsive to an alternating-current source of power applied to the illuminator, for periodically generating a master reference pulse; and a control circuit, responsive to the reference position pulse and the master reference pulse, for controlling the motor to cause the reference position pulse to be generated in synchronization with the master reference pulse.

9. The illuminator of claim 8 wherein the control circuit stops the motor when the reference position pulse is not in synchronization with the master reference pulse and restarts the motor upon generation of a subsequent master reference pulse.

10. The illuminator of claim 8 wherein:

the master clock generator repeatedly counts the frequency sinusoids of the alternating-current source of power to a predetermined modulo when the alternating-current source of power is applied to the illuminator, wherein the master reference pulse is generated at each predetermined modulo;

the motor is a synchronized motor that rotates the wheel one full revolution from a one master reference pulse to a subsequent master reference pulse after the reference position pulse is synchronized with the master reference pulse.

11. In a pool lighting system including a plurality of illuminators each powered by a common alternating-current power source, each illuminator comprising:

at least one bulb;

at least one bundle of fiber-optic cables;

a color wheel disposed between the at least one bulb and the at least one bundle of fiber-optic cables, the color wheel including a plurality of color filters;

a magnet, affixed to the color wheel, for generating a magnetic field;

a motor for rotating the color wheel a full revolution in a predetermined period, wherein the plurality of color filters pass sequentially between the at least one bulb and the at least one bundle of fiber-optic cables;

a sensor, affixed to a non-rotating portion of the illuminator, for generating a reference position pulse each time the sensor senses the magnetic field as the magnet rotates with the color wheel;

a master clock generator for periodically generating a master reference pulse when the alternating-current source of power is applied to the illuminator, the period between successive master reference pulses is equal to the predetermined period, wherein the master reference pulse of each illuminator is in synchronization with the master reference pulse of all other illuminators; and a control circuit, responsive to the master reference pulse and the reference position pulse, for controlling the motor to cause the reference position pulse to be generated in synchronization with the master reference pulse, whereby the color wheel of each of the plurality of illuminators are synchronized.

12. Each illuminator of claim 11, wherein the control circuit stops the motor when the reference position pulse is not in synchronization with the master reference pulse and restarts the motor upon generation of a subsequent master reference pulse.

13. An illuminator including a color wheel, the illuminator being powered by an alternating-current power source, the illuminator comprising:

means for rotating the color wheel; and means for controlling the means for rotating the color wheel to place the color wheel at a predetermined position after a predetermined time subsequent to the alternating-current source of power being initially applied to the illuminator, wherein the color wheel of each illuminator of a plurality of illuminators powered by the same alternating-current source of power is synchronized to all other color wheels.

14. An illuminator including a color wheel, the illuminator comprising:

means for rotating the color wheel;

means for generating a reference position pulse when the color wheel is at a predetermined position;

means for periodically generating a master reference pulse; and means for controlling the means for rotating the color wheel to cause the reference position pulse to be generated in synchronization with the master reference pulse.

15. A method for synchronizing the colors of a pool lighting system including a plurality of illuminators, each illuminator having a rotatable color wheel, each illuminator being powered by a common alternating-current source of power, the method performed by each illuminator comprising:

periodically generating a master reference pulse upon applying the alternating-current source of power to the illuminator;

generating a reference position pulse when the color wheel is at a predetermined position;

stopping the motor when the reference position pulse is not in synchronization with the master reference pulse; and restarting the motor upon generation of a subsequent master reference pulse.

* * * * *